US008193990B2

(12) United States Patent
Nakabayashi et al.

(10) Patent No.: US 8,193,990 B2
(45) Date of Patent: Jun. 5, 2012

(54) MICROSTRIP ARRAY ANTENNA

(75) Inventors: Kento Nakabayashi, Anjo (JP); Kunio Sakakibara, Nagoya (JP)

(73) Assignees: Denso Corporation, Kariya (JP); National University Corporation Nagoya Institute of Technology, Nagoya (JP)

( * ) Notice: Subject to any disclaimer, the term of this patent is extended or adjusted under 35 U.S.C. 154(b) by 386 days.

(21) Appl. No.: 12/462,112

(22) Filed: Jul. 29, 2009

(65) Prior Publication Data

US 2010/0026584 A1 Feb. 4, 2010

(30) Foreign Application Priority Data

Jul. 31, 2008 (JP) ..... 2008-198297

(51) Int. Cl.
*H01Q 1/38* (2006.01)

(52) U.S. Cl. ..... 343/700 MS; 343/853

(58) Field of Classification Search ..... 343/700 MS, 343/846, 850, 853, 824
See application file for complete search history.

(56) References Cited

U.S. PATENT DOCUMENTS

| | | | | |
|---|---|---|---|---|
| 5,422,649 | A * | 6/1995 | Huang | 343/700 MS |
| 5,594,455 | A | 1/1997 | Hori et al. | |
| 6,424,298 | B1 | 7/2002 | Nishikawa et al. | |
| 7,109,929 | B1 * | 9/2006 | Ryken et al. | 343/700 MS |
| 2007/0279303 | A1 * | 12/2007 | Schoebel | 343/713 |

FOREIGN PATENT DOCUMENTS

| | | |
|---|---|---|
| CN | 1116779 | 2/1996 |
| CN | 101019274 | 8/2007 |
| DE | 101 20 533 | 11/2002 |
| EP | 1253669 | 10/2002 |
| JP | 8-065038 | 3/1996 |
| JP | 11-312922 | 11/1999 |
| JP | 2001-044752 | 2/2001 |
| JP | 2001-111332 | 4/2001 |
| JP | 2001-196816 | 7/2001 |
| JP | 2002-271131 | 9/2002 |
| JP | 2007-053656 | 3/2007 |
| WO | WO 2006/029936 | 3/2006 |

OTHER PUBLICATIONS

Office action dated Mar. 25, 2010 in corresponding German Application No. 10 2009 035359.3.
Office action dated Feb. 7, 2012 in corresponding Japanese Application No. 2008-198297.
Office action dated Mar. 26, 2012 in corresponding Chinese Application No. 2009 10165544.2.

* cited by examiner

*Primary Examiner* — Hoang V Nguyen
(74) *Attorney, Agent, or Firm* — Harness, Dickey & Pierce, PLC

(57) ABSTRACT

The microstrip array antenna includes a dielectric substrate formed with a conductive ground plate at a back surface thereof, and strip conductors formed on a front surface of the dielectric substrate. The strip conductors includes a linear main feeding strip line, and a plurality of array elements connected to the main feeding strip line, the array elements being disposed at least one of both sides of the main feeding strip line at a predetermined interval along a longitudinal direction of the main feeding strip line. Each of the array elements includes a sub-feeding strip line connected to the main feeding strip line, a rectangular radiating antenna element connected to a terminal end of the sub-feeding strip line, and a stub connected to the sub-feeding strip line. The stub is disposed between the main feeding strip line and the radiating antenna element.

19 Claims, 11 Drawing Sheets

MICROSTRIP ARRAY ANTENNA

CROSS-REFERENCE TO RELATED APPLICATION

This application is related to Japanese Patent Application No. 2008-198297 filed on Jul. 31, 2008, the contents of which are hereby incorporated by reference.

BACKGROUND OF THE INVENTION

1. Field of the Invention

The present invention relates to a microstrip array antenna including a dielectric substrate, which is usable as a transmitting antenna or a receiving antenna of various radio wave sensors such as a vehicle-mounted radar.

2. Description of Related Art

A microstrip array antenna constituted of strip conductors formed on a dielectric substrate is becoming widely used as a transmitting/receiving antenna of various radio wave sensors including a vehicle mounted-radar such as an adaptive cruise control system for its advantages of slimness, low cost and high productivity.

Meanwhile, since a microstrip line has a large transmission loss at high frequency, there has been a problem that it is difficult to embody a microstrip array antenna having a high gain at high frequency. Accordingly, it is proposed to use a series-feed microstrip array antenna in spite of its design complexity instead of a parallel-feed microstrip array antenna widely used for its design simplicity. For example, refer to Japanese Patent Application Laid-open No. 2001-44752.

FIG. 20 shows an example of a series-feed microstrip array antenna 100 as proposed by this Patent Document. The microstrip array antenna 100 has a structure in which strip conductors are formed on a front surface of a dielectric substrate provided with a conductive ground plate at its back surface. In more detail, as shown in FIG. 20, a plurality of rectangular radiating antenna elements 101, 102, 103, 111, 112, . . . , are projectingly disposed at regular intervals on both sides of a straight feeding strip line 120.

Each of the radiating antenna elements 101, 102, 103, disposed on one side edge (on the upper side edge in FIG. 20) of the feeding strip line 120 are projectingly disposed at an inclination of approximately 45 degrees to the feeding strip line 120. Each of the radiating antenna elements 111, 112, . . . , disposed on the other side edge (on the lower side edge in FIG. 20) of the feeding strip line 120 are projectingly disposed at an inclination of approximately −135 degrees to the feeding strip line 120.

Input power fed to the feeding strip line 120 from an input end (leftward end in FIG. 20) thereof propagates to a terminal end (rightward end in FIG. 20), while sequentially coupling to the radiating antenna elements 101, 102, 103, 111, 112, . . . . Accordingly, the input power gradually decreases toward the terminal end.

To achieve desired directivity by use of such a series-feed microstrip array antenna, each of the radiating antenna elements has to be designed independently, because the series-feed microstrip array antenna is excited by traveling wave, and accordingly the coupling factor differs from one radiating antenna element to another. The coupling factors of the radiating antenna elements can be controlled by adjusting the element widths thereof.

For example, when all the radiating antenna elements are formed to have the same shape and size so that they have the same coupling factor, the power radiated from the antenna decreases toward the terminal end, because the input power inputted from the input end decreases toward the terminal end.

It is possible that all the radiating antenna elements have the same radiation factor if the radiating antenna element closer to the input end has a smaller element width to have a smaller radiation factor, and the radiating antenna element closer to the terminal end has a larger element width to have a larger radiation factor, as is the case with the microstrip array antenna 100 shown in FIG. 20.

As exemplified above, conventional series-feed microstrip array antennas are configured such that each of the radiating antenna elements has an adjusted element width to have a desired coupling factor.

However, since the adjustable range of the coupling factor of each radiating antenna element having such a configuration is relatively narrow, there has been a problem that desired antenna characteristics (desired directivity, for example) cannot be achieved in some cases.

In addition, when the element width is increased to achieve a large coupling factor, since a high frequency current flowing in each radiating antenna element along its lateral direction increases, a radio wave emitted in the direction crossing the direction in which a main polarized wave is emitted (the longitudinal direction of the radiating antenna elements) increases. This causes a problem that the radiation level of a polarized wave emitted in the crossing direction increases.

Furthermore, since each radiating antenna element is directly connected to the feeding strip line, it is difficult to achieve impedance matching for each radiating antenna element, and accordingly, it is difficult for each radiating antenna element to exhibit a desired reflection characteristic.

SUMMARY OF THE INVENTION

The present invention provides a microstrip array antenna comprising:

a dielectric substrate formed with a conductive ground plate at a back surface thereof; and strip conductors formed on a front surface of the dielectric substrate;

the strip conductors including a linear main feeding strip line, and a plurality of array elements connected to the main feeding strip line, the array elements being disposed at least one of both sides of the main feeding strip line at a predetermined interval along a longitudinal direction of the main feeding strip line, each of the array elements including a sub-feeding strip line connected to the main feeding strip line, a rectangular radiating antenna element connected to a terminal end of the sub-feeding strip line, and a stub connected to the sub-feeding strip line, the stub being disposed between a connecting position between the main feeding strip line and the sub-feeding strip line and a connecting position between the sub-feeding strip line and the radiating antenna element.

The present invention also provides a microstrip array antenna comprising:

a dielectric substrate formed with a conductive ground plate at a back surface thereof; and strip conductors formed on a front surface of the dielectric substrate;

the strip conductors including a linear main feeding strip line, and at least one array element disposed at each of both sides of the main feeding strip line, the array element being connected to the main feeding strip line, the array element including a sub-feeding strip line connected to the main feeding strip line, a rectangular radiating antenna element connected to a terminal end of the sub-feeding strip line, and a stub connected to the sub-feeding strip line, the stub being disposed between a connecting position between the main feeding strip line and the sub-feeding strip line and a connecting position between the sub-feeding strip line and the radiating antenna element.

According to the present invention, there is provided a microstrip array antenna in which undesired cross-polarized components are suppressed, and reflection is reduced to achieve a desired coupling factor at each of its array elements.

Other advantages and features of the invention will become apparent from the following description including the drawings and claims.

PREFERRED EMBODIMENTS OF THE INVENTION

First Embodiment

Figure 1A:
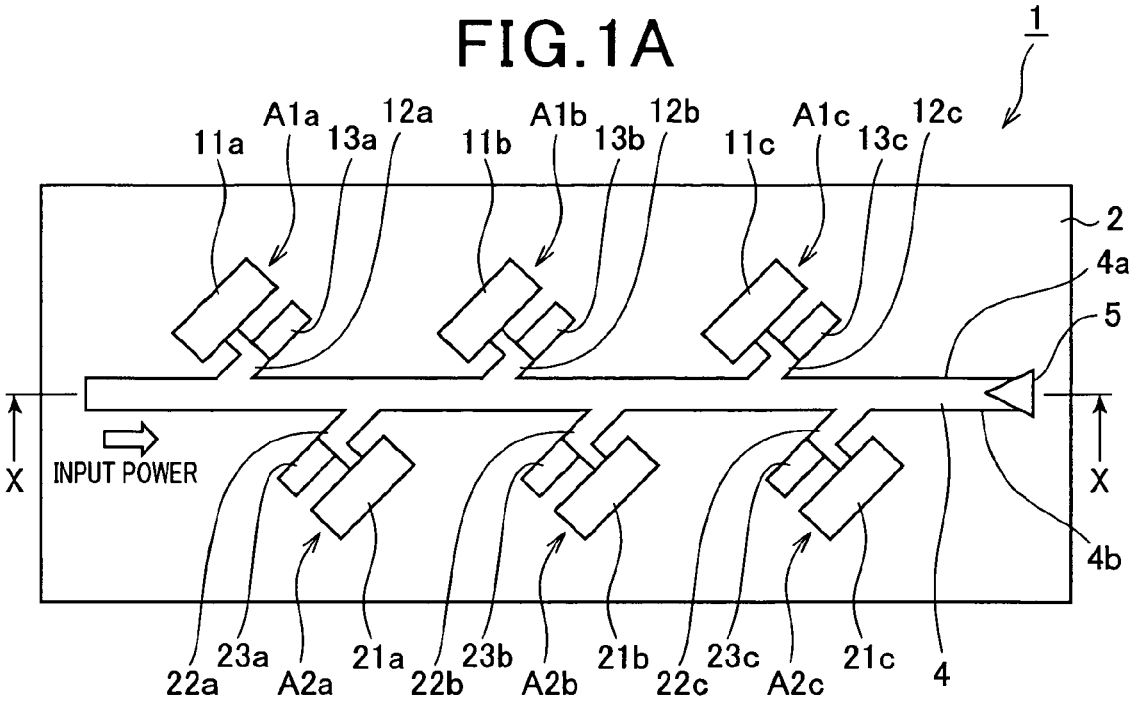
FIG. 1A is a plan view of a microstrip array antenna according to a first embodiment of the invention.
Figure 1B:
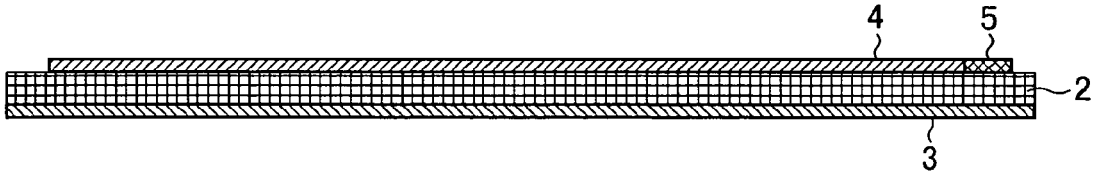
FIG. 1B is a cross-sectional view of the microstrip array antenna taken along the line X-X in FIG. 1A.

FIG. 1A is a plan view of a microstrip array antenna 1 according to a first embodiment of the invention. FIG. 1B is a cross-sectional view of the microstrip array antenna 1 taken along the line X-X in FIG. 1A.

The microstrip array antenna 1 is constituted of strip conductors formed on a front surface of a dielectric substrate 2 formed with a conductive ground plate 3 at its back surface. As shown in FIG. 1A, the strip conductors on the front surface of the dielectric substrate 2 includes a linearly disposed main feeding strip line 4, and a plurality of array elements A1*a*, A1*b*, A1*c*, A2*a*, A2*b* and A2*c* connected to either side edge of the main feeding strip line 4.

In more detail, the array elements A1*a*, A1*b* and A1*c* are connected to a first side edge 4*a* (one of two side edges of the main feeding strip line 4) at a predetermined interval therebetween. This predetermined interval is equal to the wavelength λg of a radio wave propagating the strip conductors at an operating frequency (76.5 GHz in this embodiment). Hereinafter, this wavelength is referred to as a waveguide wavelength. The other array elements A2*a*, A2*b* and A2*c* are connected to a second side edge 4*b* (the other of the two side edges of the main feeding strip line 4) at the predetermined interval equal to the waveguide wavelength λg therebetween.

The array elements A1*a*, A1*b* and A1*c* and the array elements A2*a*, A2*b* and A2*c* are shifted in their positions in the longitudinal direction of the main feeding strip line 4 by approximately λg/2.

The array element A1*a* which is the closest of the array elements connected to the first side edge 4*a* of the main feeding strip line 4 to the input end is constituted of a sub-feeding strip line 12*a* connected to the main feeding strip line 4, a rectangular radiating antenna element 11*a* connected to the terminal end of the sub-feeding strip line 12*a*, and a stub 13*a* connected to a predetermined middle portion of the sub-feeding strip line 12*a*.

Likewise, the array element A1*b*, which is the second closest of the array elements connected to the first side edge 4*a* of the main feeding strip line 4 to the input end, is constituted of a sub-feeding strip line 12*b*, a rectangular radiating antenna element 11*b* and a stub 13*b*. The array element A1*c*, which is the third closest of the array elements connected to the first side edge 4*a* of the main feeding strip line 4 to the input end, is constituted of a sub-feeding strip line 12*c*, a rectangular radiating antenna element 11*c* and a stub 13*c*. The array element A2*a*, which is the closest of the array elements connected to the second side edge 4*b* of the main feeding strip line 4 to the input end, is constituted of a sub-feeding strip line 22*a*, a rectangular radiating antenna element 21*a* and a stub 23*a*. The array element A2*b* which is the second closest of the array elements connected to the second side edge 4*b* of the main feeding strip line 4 to the input end, is constituted of a sub-feeding strip line 22*b*, a rectangular radiating antenna element 21*b* and a stub 23*b*. The array element A2*c*, which is third closest of the array elements connected to the second side edge 4*b* of the main feeding strip line 4 to the input end, is constituted of a sub-feeding strip line 22*c*, a rectangular radiating antenna element 21*c* and a stub 23*c*.

The input power fed to the main feeding strip line 4 from the input end (the leftward end in FIG. 1) partially couples to the array elements A1*a*, A1*b*, A1*c*, A2*a*, A2*b* and A2*c* in succession to be radiated from each of them, and the remaining power propagates toward the terminal end (the rightward end in FIG. 1). Accordingly, the input power propagating through the main feeding strip line 4 gradually decreases toward the terminal end.

A matching terminal element 5 is provided in the terminal end of the main feeding strip line 4 to absorb the remaining power. However, in order to radiate power efficiently from the microstrip array antenna 1, the terminal end may be provided with a radiating antenna element instead of the matching terminal element 5.

Next, the structures of the array elements are explained. Since the array elements A1*a*, A1*b*, A1*c*, A2*a*, A2*b* and A2*c* have the same shape and size, only the array element A1*a* closest of the array elements connected to the first side edge 4*a* of the main feeding strip line 4 to the input end is explained with reference to FIG. 2.

Figure 2:
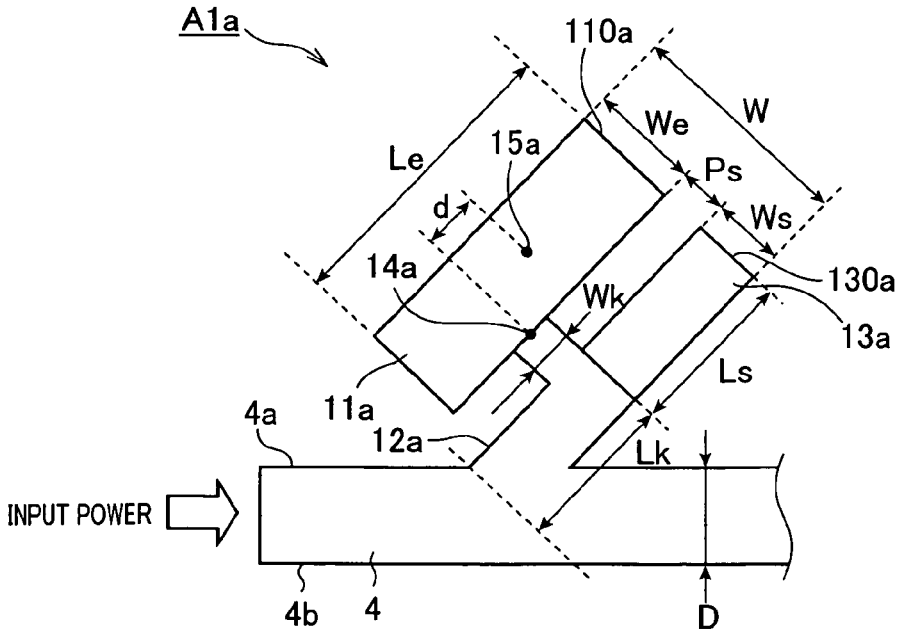
FIG. 2 is a plan view showing a detailed structure of one of array elements constituting the microstrip array antenna according to the first embodiment of the invention.

As shown in FIG. 2, the sub-feeding strip line 12*a* of the array element A1*a* is L-shaped so as to include a portion bent at an angle of approximately 90 degrees. In more detail, the sub-feeding strip line 12*a* includes a first line section of a length of Lk extending from the first side edge 4*a* of the main feeding strip line 4 at an angle of approximately 45 degrees with respect to the longitudinal line of the main feeding strip line 4, and a second line section extending from the front end of the first line section at an angle of approximately 90 degrees with respect to the longitudinal direction of the first line section.

The sub-feeding strip line 12*a* is provided with the stub 13*a* of a length of Ls extending from the bent portion of the sub-feeding strip line 12*a* at an angle of approximately 45 degrees with respect to the longitudinal direction of the main feeding strip line 4. The stub 13*a* is formed to extend from the first line section of the sub-feeding strip line 12*a* in the same direction as the longitudinal direction of the first line section. Accordingly, the first line section and the stub 13*a* can be assumed to constitute a straight strip line.

The terminal end of the sub-feeding strip line 12*a* (the end portion of the second line section) is connected with the radiating antenna element 11*a*. The length Le of the radiating antenna element 11*a* is equal to approximately half the waveguide wavelength ($\lambda g/2$).

The radiating antenna element 11*a* is formed in a rectangular shape having a length of Le smaller than its width of We. The sub-feeding strip line 12*a* is connected to a feeding point 14*a* on a longer side edge of the radiating antenna element 11*a*. This feeding point 14*a* is set at a predetermined position between the center portion and one end portion of the longer side of the radiating antenna element 11*a*.

The impedance of the rectangular radiating antenna element 11*a* is lower at its longer side edge than at its shorter side on the whole. In the longer side edge, the impedance is substantially 0 at its center portion, while the impedance is high at its end portions. Accordingly, the feeding point 14*a* is set at a position between the center portion and one end portion of the longer side edge of the radiating antenna element 11*a*, and the sub-feeding strip line 12*a* is connected to this feeding point 14*a*, so that impedance matching can be achieved easily. For example, when the characteristic impedance of the sub-feeding strip line 12*a* is 50Ω, the sub-feeding strip line 12*a* is connected to a point of the longer side of the radiating antenna element 11*a* where the impedance is 50Ω as the feeding point 14*a*.

The radiating antenna element 11*a* is disposed such that the longitudinal direction thereof is in parallel with the longitudinal direction of the stub 13*a*. That is, the longitudinal direction of each of the radiating antenna element 11*a* and the stub 13*a* forms an angle of approximately 45 degrees with the longitudinal direction of the main feeding strip line 4.

Since the array element A1*a* has the structure where the stub 13*a* is connected to the bent portion of the sub-feeding strip line 12*a*, a current flows through this stub 13*a* causing radio wave to be radiated also from the stub 13*a*. Although the radiation from the stub 13*a* is minute compared to the radiation from the radiating antenna element 11*a*, it is unnecessary radiation, and is undesirable intrinsically because it affects the radiation from the radiating antenna element 11*a*.

However, if the direction of the electric field radiated from the stub 13*a* is the same as the direction of the electric field radiated from the radiating antenna element 11*a*, the radiation from the stub 13*a* can be effectively used.

Accordingly, in this embodiment, the radiating antenna element 11*a* and the stub 13*a* are disposed parallel to each other. In this case, since the currents respectively flowing through the stub 13*a* and the radiating antenna element 11*a* are parallel to each other, the directions of the electric fields radiated respectively from the radiating antenna element 11*a* and the stub 13*a* are the same with each other. Hence, the stub 13 can be used not only for impedance matching but also as a radiating antenna element.

The array element A1*a* has the configuration in which one of the contour edges of the radiating antenna element 11*a* as a field-emission edge line 110*a* and a field-emission edge line 130*a* of the stub 13*a* are on the same straight line.

As explained above, since the radiating antenna element 11*a* and the stub 13*a* are disposed such that both their longitudinal directions are inclined by an angle of approximately 45 degrees with respect to the longitudinal direction of the main feeding strip line 4, both their field-emission edge lines

110*a* and 130*a* are inclined by an angle of approximately −135 degrees with respect to the longitudinal direction of the main feeding strip line 4.

In this embodiment, the radiating antenna element 11*a* is connected to the main feeding strip line 4 not directly but through a matching strip line constituted of the sub-feeding strip line 12*a* and the stub 13*a*. This makes it possible to achieve impedance matching for reducing reflection, because the position at which the sub-feeding strip line 12*a* is connected to the radiating antenna element 11*a*, and the length, shape and connecting position of the stub 13*a* can be determined arbitrarily.

In addition, the provision of the matching strip line enables controlling the coupling factor between the main feeding strip line 4 and the array element A1*a*, which is equal to the to some extent, because the size of the stub 13*a* can be determined arbitrarily, for example.

Here, the coupling factor is a factor which indicates how much portion of the input power propagating through the main feeding strip line is supplied to the array element. That is, the coupling factor=(input power−transmitting amount of input power−reflecting amount of input power)/input power. Accordingly the amount of radiation at the array element=ratio between radiated power and incident power into array antenna. Hence, by controlling the coupling factor, the radiation factor can be controlled.

As shown in FIG. 2, the size parameters to be determined in designing the array element A1*a* include the length Le and width We of the radiating antenna element 11*a*, the length Ls and width Ws of the stub 13*a*, the length Lk of the first line section and the width Wk of the second line section of the sub-feeding strip line 12*a*, the interval Ps between the radiating antenna element 11*a* and the stub 13*a* in their width direction, the element width W (=We+Ws+Ps) of the entire array element A1*a*, and the distance d between the center point 15*a* and the feeding point 14*a* of the radiating antenna element 11*a* in the longitudinal direction. By appropriately determining these size parameters, the array element having desired coupling factors, impedance, reflection factor, and radiation factor can be obtained.

The other array elements A1*b* and A1*c* connected to the first side edge 4*a* of the main feeding strip line 4 have the same structure as the array element A1*a* shown in FIG. 2. Also, the array elements A2*a*, A2*b* and A2*c* connected to the second side edge 4*b* of the main feeding strip line 4 have the same structure as the array element Ala shown in FIG. 2. However, the connection angle to the main feeding strip line 4 of the array elements A2*a*, A2*b* and A2*c* is different from that of the array elements A1*a*, A1*b* and A1*c*. That is, the array elements A2*a*, A2*b* and A2*c* are formed such that their sub-feeding strip lines 22*a*, 22*b* and 22*c* are inclined by an angle of approximately −135 degrees with respect to the main feeding strip line 4.

In other words, the longitudinal directions of the radiating antenna elements 21*a*, 21*b* and 21*c* and the longitudinal directions of the stubs 23*a*, 23*b* and 23*c* of the array elements A2*a*, A2*b* and A2*c* are all inclined by an angle of approximately −135 degrees with respect to the longitudinal direction of the main feeding strip line 4.

Hence, in the microstrip array antenna 1 of this embodiment, the longitudinal directions of radiating antenna elements 11*a*, 11*b*, 11*c*, 21*a*, 21*b* and 21*c* and the stubs 13*a*, 13*b*, 13*c*, 23*a*, 23*b* and 23*c* of the array elements A1*a*, A1*b*, A1*c*, A2*a*, A2*b* and A2*c* connected to the first side edge 4*a* or the second side edge 4*b* of the main feeding strip line 4 are parallel to one another.

Furthermore, in the microstrip array antenna 1 of this embodiment, the radiating antenna elements 11*a*, 11*b* and 11*c* of the array elements A1*a*, A1*b* and A1*c* connected to the first side edge 4*a* of the main feeding strip line 4 do not have the same width. The radiating antenna element closer to the input end has a smaller width We. Accordingly, the radiating antenna element 11*a* which is the closest to the input end has the smallest width We, and the radiating antenna element 11*c* closest to the terminal end has the largest width We.

The above also applies to radiating antenna elements 21*a*, 21*b* and 21*c* of the array elements A2*a*, A2*b* and A2*c* connected to the second side edge 4*b* of the main feeding strip line 4.

The reason why the widths of the radiating antenna elements are varied depending on their connecting positions to main feeding strip line 4 is to make the radiation factors of the array elements A1*a*, A1*b*, A1*c*, A2*a*, A2*b* and A2*c* the same with one another.

Since the level of the input power propagating through the main feeding strip line 4 is larger at a position closer to the input end, to make the radiation factors of the array elements A1*a*, A1*b*, A1*c*, A2*a*, A2*b* and A2*c* the same one another, the width We of the radiating antenna element closer to the input end has to be smaller to make its coupling factor smaller. On the other hand, the width We of the radiating antenna element more distant from the input end has to be larger to make its coupling factor larger.

Although the widths of the radiating antenna elements are determined in order that radiation factors of the array elements Ala, A1*b*, A1*c*, A2*a*, A2*b* and A2*c* are equal to one another in this embodiment, they may be determined depending on specification and characteristics required of the microstrip array antenna 1.

This is because the excitation amplitude to be achieved at each of the radiating antenna elements should be determined depending on the directivity characteristic required of the microstrip array antenna 1, and the width We of each of the radiating antenna elements is determined to achieve the determined excitation amplitude.

Figure 3:
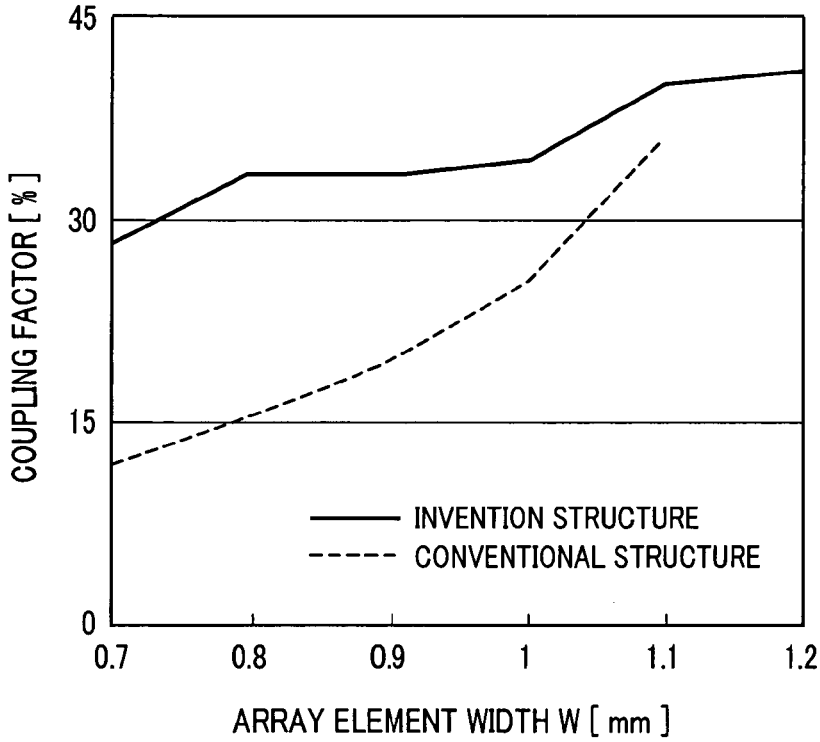
FIG. 3 is a graph showing a coupling factor of the array element of the first embodiment in contradistinction to that of a radiating antenna element of a conventional microstrip array antenna.
Figure 4:
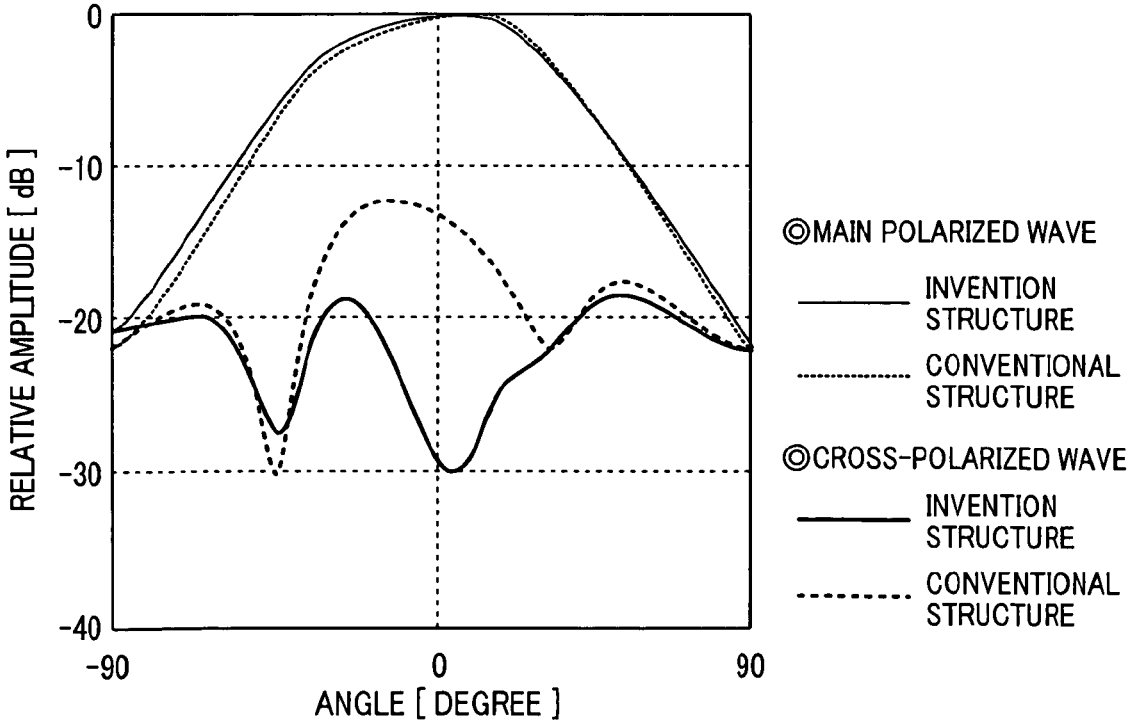
FIG. 4 is a graph showing polarization characteristics of the array element of the microstrip array antenna of the first embodiment in contradistinction to those of the radiating antenna element of the conventional microstrip array antenna.
Figure 5:
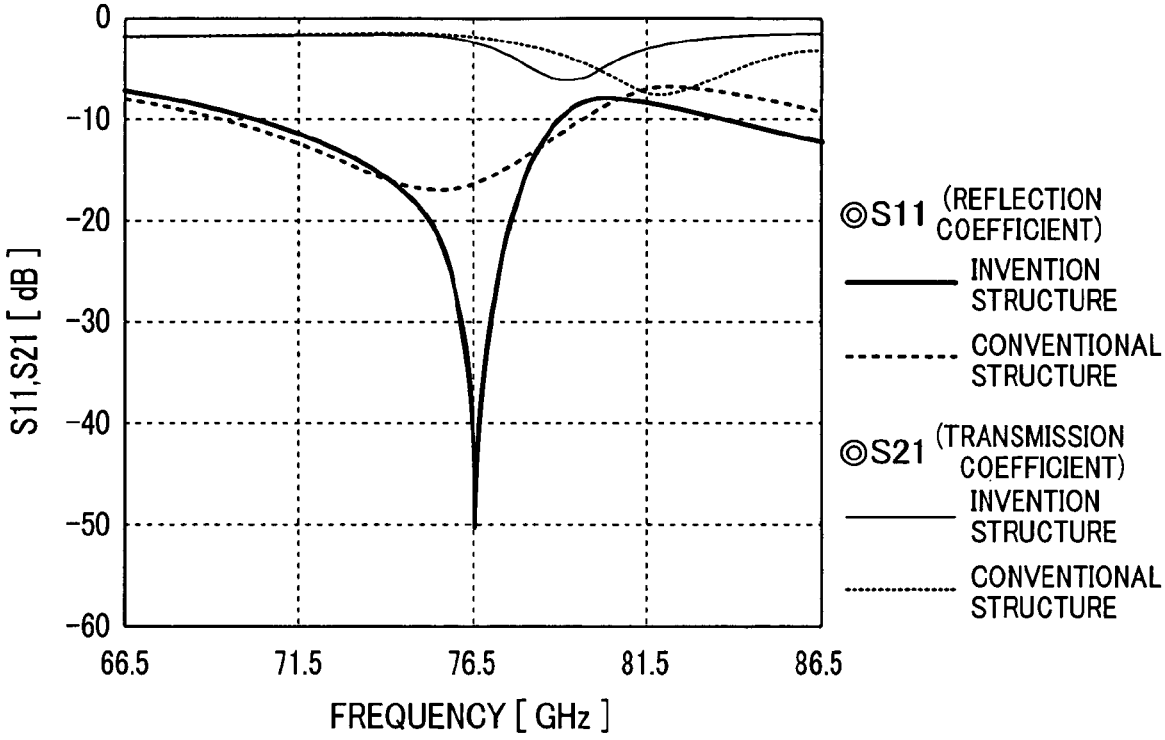
FIG. 5 is a graph showing reflection/transmission characteristics of the array element of the first embodiment in contradistinction to those of the radiating antenna element of the conventional microstrip array antenna.
Figure 20:
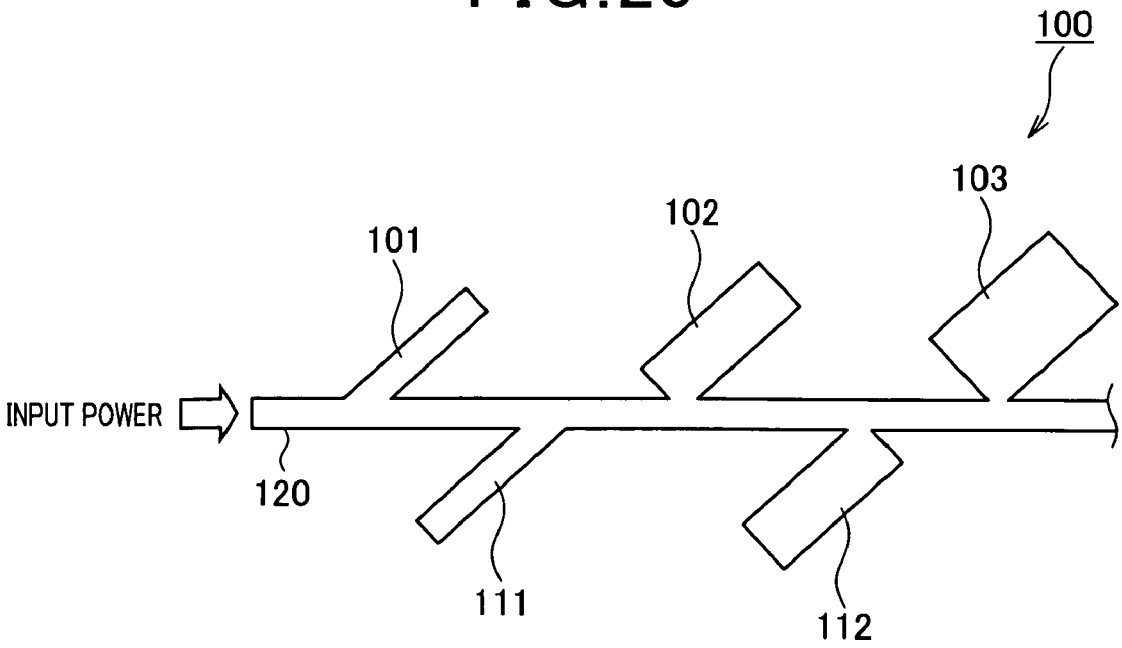
FIG. 20 is a diagram showing a conventional series-feed microstrip array antenna.

Next, various characteristics of the array element A1*a* shown in FIG. 2 are explained in contradistinction to those of the radiating antenna element of the conventional microstrip array antenna 100 shown in FIG. 20 with reference to FIGS. 3 to 5. FIG. 3 is a graph showing their coupling characteristics, FIG. 4 is a graph showing their polarization characteristics, and FIG. 5 is a graph showing their reflection/transmission characteristics. In FIGS. 3 to 5, the term "INVENTION STRUCTURE" means the structure in which the array element A1*a* is connected to the main feeding strip line 4 as shown in FIG. 2, and the term "CONVENTIONAL STRUCTURE" means the structure in which the rectangular radiating antenna element is directly connected to the main feeding strip line 4 as shown in FIG. 20.

First, the coupling characteristics of the invention structure and the conventional structure are explained with reference to FIG. 3. In FIG. 3, the horizontal axis represents the element width W (mm) of the entire array element. As seen from FIG. 3, the invention structure achieves a large coupling factor compared to the conventional structure. For example, when the element width W is 1 mm, the conventional structure exhibits a coupling factor of 25.54%, while the invention structure exhibits a coupling factor as large as 34.5%.

In the conventional structure, to achieve a coupling factor larger than 30%, the element width has to be larger than 1 mm. As the element width is increased, the current flowing in the direction crossing the longitudinal direction of the radiating antenna element (main polarization component) increases, other than the current flowing in this longitudinal direction (cross-polarization component), and accordingly, the radiation level of the cross-polarized wave increases. Therefore, when taking account of the influence of the cross-polarized wave, the coupling factor of the conventional structure is limited to the order of 20%. Accordingly, it has been difficult to provide a radiating antenna element having a coupling factor larger than 30%.

On the other hand, in the invention structure, to achieve a coupling factor of 30% for example, the element width is required only to be larger than 0.7 mm. According to the invention structure, it is possible to achieve a sufficiently large coupling factor without substantially increasing the radiation level of the cross-polarized wave.

Next, the polarization characteristics of the invention structure and the conventional structure are explained with reference to FIG. 4. FIG. 4 shows comparison in the directivity (relative amplitude) between the invention structure and the conventional structure for each of the main polarized wave and the cross-polarized wave when the element width is 1 mm. In FIG. 4, the horizontal axis represents horizontal plane angle with respect to the direction of the main polarized wave.

As seen from FIG. 4, the invention structure and the conventional structure exhibit the same characteristic as for the main polarized wave. On the other hand, the level of the cross-polarized wave is sufficiently reduced on the whole in the invention structure compared to the conventional structure. Particularly, the level of the cross-polarized wave at 0 degrees (main beam direction) is substantially reduced in the invention structure.

The reason is that since the width We of the radiating antenna element can be made smaller in the invention structure than in the conventional structure, the component of a current other than the current flowing in the direction of the main polarization component can be made small compared to the conventional structure. Hence, according to the invention structure, the level of the cross-polarized wave can be substantially reduced, making the width We of the radiating antenna element small compared to that in the conventional structure, while achieving the same characteristic as the conventional structure for the main polarized wave.

Next, the reflection and transmission characteristics of the invention structure and the conventional structure are explained with reference to FIG. 5. FIG. 5 shows comparison in the reflection characteristic (reflection coefficient: S11) and the transmission characteristic (transmission coefficient: S21) between the invention structure and the conventional structure for each of the main polarized wave and the cross-polarized wave when the element width is 1 mm.

As seen form FIG. 5, the invention structure is superior on the whole to the conventional structure in their transmission coefficients S21. It means that the invention structure has less loss, and therefore has a higher efficiency than the conventional structure.

On the other hand, the reflection coefficient S11 drops at the operating frequency of 76.5 GHz much deeper in the invention structure than in the conventional structure. At the operating frequency, the reflection coefficient S11 drops down to −16.1 dB in the conventional structure, while it drops as low as −50.4 dB in the invention structure.

This is because the radiating antenna element is directly connected to the main feeding strip line in the conventional structure, while the radiating antenna element is connected to the main feeding strip line through the matching strip line in the invention structure. Connecting the radiating antenna element to the main feeding strip line through the matching strip line makes it easy to achieve impedance matching to reduce the reflection.

Figure 6:
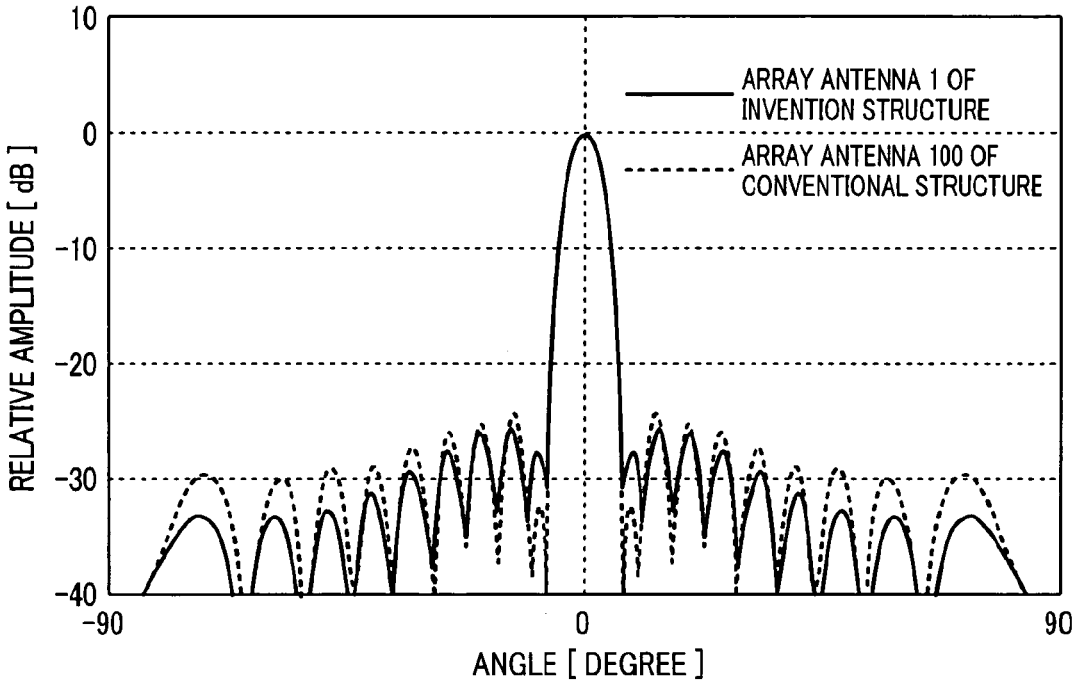
FIG. 6 is a graph showing horizontal directivity of the microstrip array antenna of the first embodiment in contradistinction to that of the conventional microstrip array antenna.

Next, the horizontal directivity (relative amplitude) of the microstrip array antenna 1 shown in FIG. 1 is explained in contradistinction to that of the conventional microstrip array antenna 100 shown in FIG. 20 with reference to FIG. 6. In FIG. 6, the term "ARRAY ANTENNA 1 OF INVENTION STRUCTURE" means the microstrip array antenna 1 shown in FIG. 1, and the term "ARRAY ANTENNA 100 OF CONVENTIONAL STRUCTURE" means the microstrip array antenna 100 shown in FIG. 20.

As seen from FIG. 6, the microstrip array antenna 1 of the invention structure exhibits substantially the same characteristic as the microstrip array antenna 100 of the conventional structure in the mainlobe level at an angle of 0 degrees, however, the sidelobe level is greatly reduced in the microstrip array antenna 1 of the invention structure.

This is because the array elements A1*a*, A1*b*, A1*c*, A2*a*, A2*b* and A2*c* constituting the microstrip array antenna 1 can be designed and fabricated precisely to achieve desired characteristics. Since the coupling factors can be controlled precisely, while achieving impedance matching and suppressing the cross-polarized component, the microstrip array antenna 1 can achieve high performance and high directivity.

Figure 7:
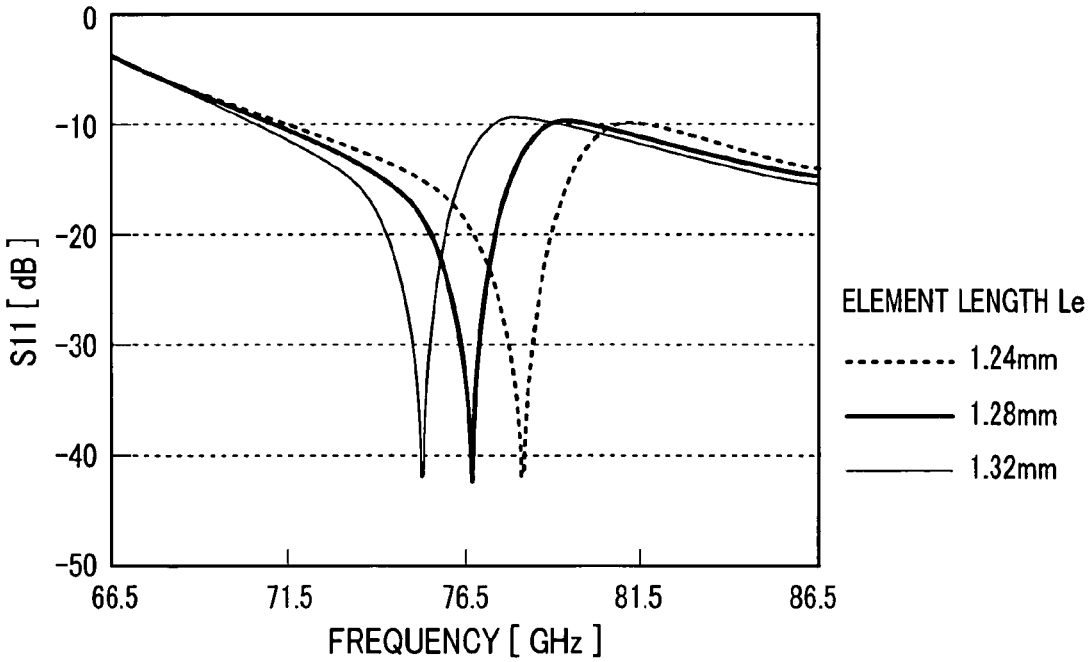
FIG. 7 is a graph showing variation of the reflection characteristic of the array element of the microstrip array antenna of the first embodiment when the length of the radiating antenna element is varied.
Figure 8:
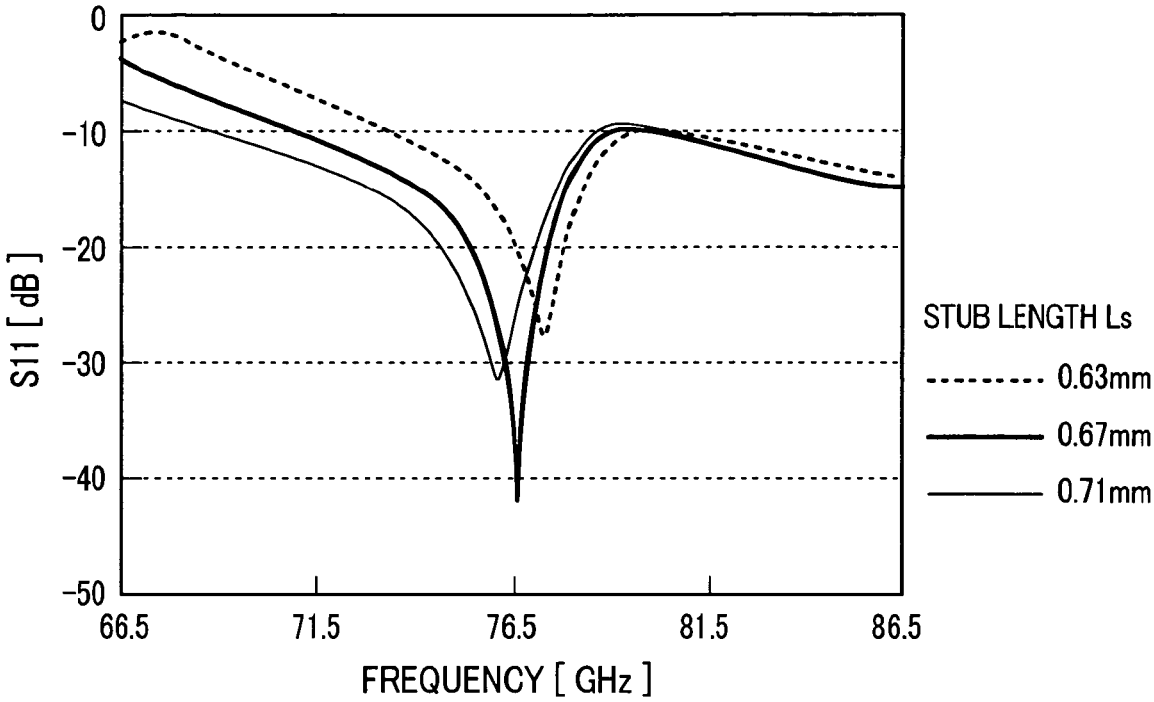
FIG. 8 is a graph showing variation of the reflection characteristic of the array element of the microstrip array antenna of the first embodiment when the length of its stub is varied.

Next, some relationships between the size parameters of the array elements A1*a*, A1*b*, A1*c*, A2*a*, A2*b* and A2*c* and the characteristics of the microstrip array antenna 1 are explained with reference to FIGS. 7 and 8. FIG. 7 is a graph showing variation of the reflection characteristic (reflection coefficient S11) when the length of the radiating antenna element 11*a* (may be referred to simply as "element length Le" hereinafter) is varied. FIG. 8 is a graph showing variation of the reflection characteristic (reflection coefficient S11) when the length of the stub 13*a* (may be referred to simply as "stub length Ls" hereinafter) is varied.

As shown in FIG. 7, when the element length Le is varied, the characteristic curve of the reflection coefficient S11 shifts in the frequency direction, that is, the resonance frequency is shifted. In this embodiment, since the operating frequency is 76.5 GHz, the element length Le is set to 1.28 mm. If the element length Le is increased, the resonance frequency shifts to the higher side, and if it is reduced, the resonance frequency shifts to the lower side.

On the other hand, when the stub length Ls is varied, both the resonance frequency and the level of the reflection coefficient S11 are varied. In this embodiment, since the operating frequency is 76.5 GHz, the stub length Ls is set to 0.67 mm. If the stub length Ls is increased, the resonance frequency shifts to the lower side, and the reflection coefficient S11 increases on the whole, and if it is reduced, the resonance frequency shifts to the higher side, and the reflection coefficient S11 increases on the whole.

Next, the relationship between the field-emission edge line of the radiating antenna element and that of the stub, and the relationship between the stub length Ls and the characteristics of the radiating antenna element (particularly, the variation of the characteristics of the array element A1*a* depending on the relationship between the field-emission edge line of the stub 13*a* and that of the radiating antenna element 11*a*) are explained with reference to FIGS. 9 and 10.

As described above, the characteristics of the array element Ala vary depending on the element length Le of the radiating antenna element 11*a* and the stub length Ls of the stub 13*a*. As explained below, when the field-emission edge line 110*a* of the radiating antenna element 11*a* and the field-emission edge line 130*a* of the stub 13*a* are one the same straight line, the characteristics of the array element A1*a* such as the coupling factor and reflection characteristic become favorable.

Figure 9:
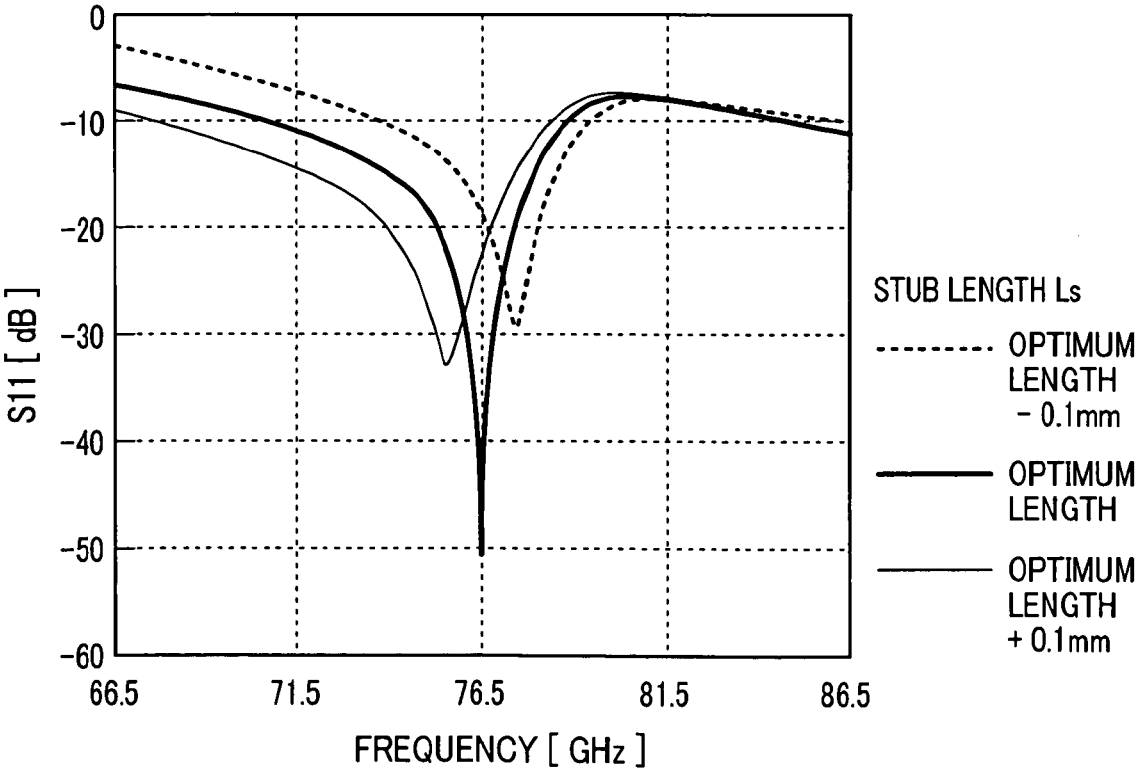
FIG. 9 is a graph showing variation of the reflection characteristic of the array element of the microstrip array antenna of the first embodiment in which a field-emission edge line of the radiating antenna element and a field-emission edge line of the stub are one the same straight line, when the length of the stub is varied.
Figure 10:
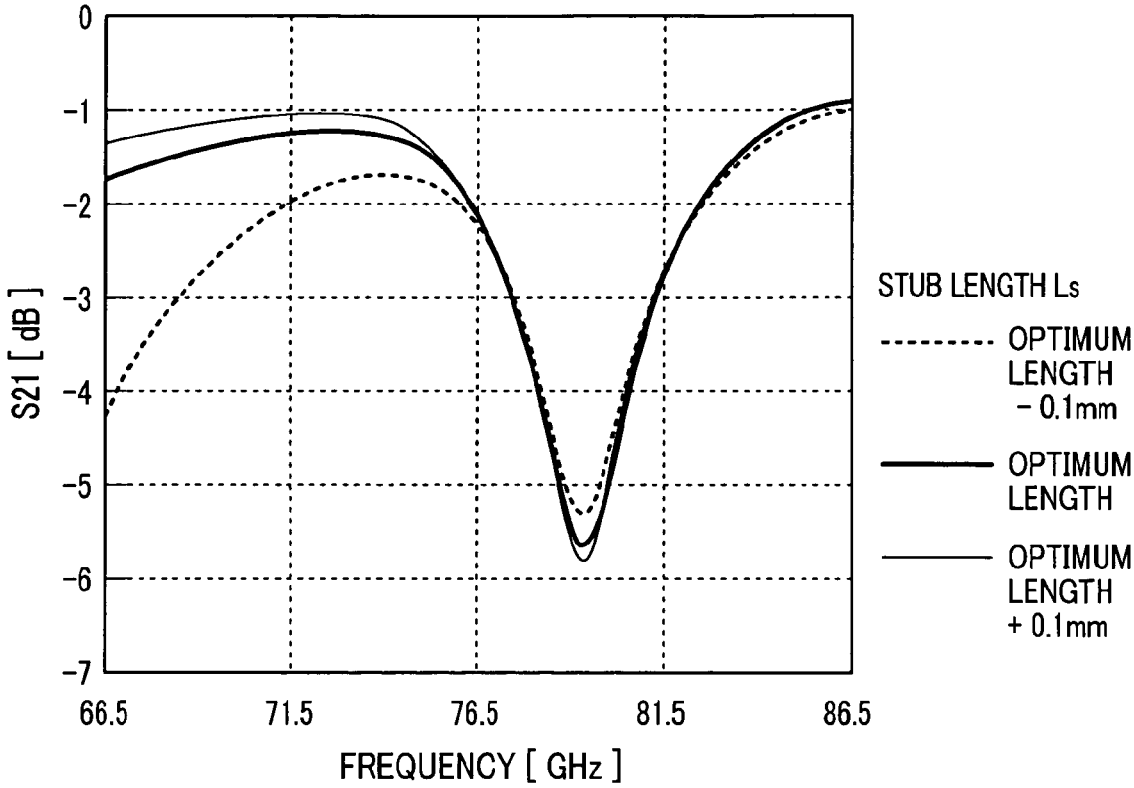
FIG. 10 is a graph showing variation of the transmission characteristic of the array element of the microstrip array antenna of the first embodiment in which the field-emission edge line of the radiating antenna element and the field-emission edge line of the stub are one the same straight line, when the length of the stub is varied.

FIGS. 9 and 10 are graphs respectively showing variation of the reflection characteristic and the transmission characteristic of the array element A1*a* in which the field-emission edge line 110*a* of the radiating antenna element 11*a* and the field-emission edge line 130*a* of the stub 13*a* are one the same straight line, when the stub length Ls is varied. In FIGS. 9 and 10, the term "OPTIUM VALUE OF STUB LENGTH Ls" means the stub length Ls when the field-emission edge line 110*a* of the radiating antenna element 11*a* and the field-emission edge line 130*a* of the stub 13*a* are on the same straight line.

As seen from FIG. 9, when the stub length Ls is at the optimum value, resonance occurs at the operating frequency, and the reflection coefficient S11 becomes minimum. When the stub length Ls is increased from this optimum value, the resonance frequency shifts to the lower side, and the reflection coefficient S11 increases on the whole. When the stub length Ls is reduced from this optimum value, the resonance frequency shifts to the higher side, and the reflection coefficient S11 increases on the whole.

On the other hand, as seen from FIG. 10, although the transmission characteristic (transmission coefficient S21) changes to some extent in the frequency band lower than the operating frequency, it changes only a little around the operating frequency.

The first embodiment described above provides the following advantages. The microstrip array antenna 1 has the structure in which each radiating antenna element is connected to the main feeding strip line 4 not directly but through the matching strip line. Accordingly, it is easy to achieve impedance matching to reduce the reflection factor of each of the array elements A1*a*, A1*b*, A1*c*, A2*a*, A2*b* and A2*c*.

The provision of the matching strip line enables controlling the coupling factor of each of the array elements A1*a*, A1*b*, A1*c*, A2*a*, A2*b* and A2*c* to some extent by adjusting the element lengths We of the radiating antenna elements 11*a*, 11*b*, 11*c*, 21*a*, 21*b* and 21*c*, and the size of the matching strip line (mainly, the stub length Ls). This enables each array element to have a large coupling factor by appropriately designing the matching strip line without increasing the element widths We. This means that a desired coupling factor can be achieved while suppressing the undesired cross-polarized components from the array elements A1*a*, A1*b*, A1*c*, A2*a*, A2*b* and A2*c*, and reducing the reflection at each of these array elements. Accordingly, the microstrip array antenna 1 of this embodiment can have a desired directivity and a high efficiency.

In this embodiment, each of the array elements A1*a*, A1*b*, A1*c*, A2*a*, A2*b* and A2*c* is connected with the sub-feeding strip line at the predetermined position between the center and the end of the longer side of its rectangular radiating antenna element. This enables achieving impedance matching with ease.

In this embodiment, each of the array elements A1*a*, A1*b*, A1*c*, A2*a*, A2*b* and A2*c* is formed such that the radiating antenna element is in parallel to the longitudinal direction of the stub so that the direction of the electric field radiated from the radiating antenna element coincides with the direction of the electric field radiated from the stub. Accordingly, in this embodiment, since the radiation component from the stub, which is conventionally an undesired component, can be effectively used together with the main polarized component from the radiating antenna element, the radiation efficiency of the entire array element can be improved.

In this embodiment, since the array elements A1*a*, A1*b*, A1*c*, A2*a*, A2*b* and A2*c* constituting the microstrip array antenna 1 are so configured that the longitudinal directions of the radiating antenna elements 11*a*, 11*b*, 11*c*, 21*a*, 21*b* and 21*c*, and the stubs 13*a*, 13*b*, 13*c*, 23*a*, 23*b* and 23*c* are all parallel, the microstrip array antenna 1 has a high radiation ability and a high receiving sensitivity.

Furthermore, since the radiating antenna elements 11*a*, 11*b*, 11*c*, 21*a*, 21*b* and 21*c* and the stubs 13*a*, 13*b*, 13*c*, 23*a*, 23*b* and 23*c* are all formed with an angle of approximately 45 degrees (or approximately −135 degrees) with respect to the longitudinal direction of the main feeding strip line 4, it is possible that the microstrip array antenna 1 has planes of polarization inclined by 45 degrees (or approximately −135 degrees).

Second Embodiment

Figure 11:
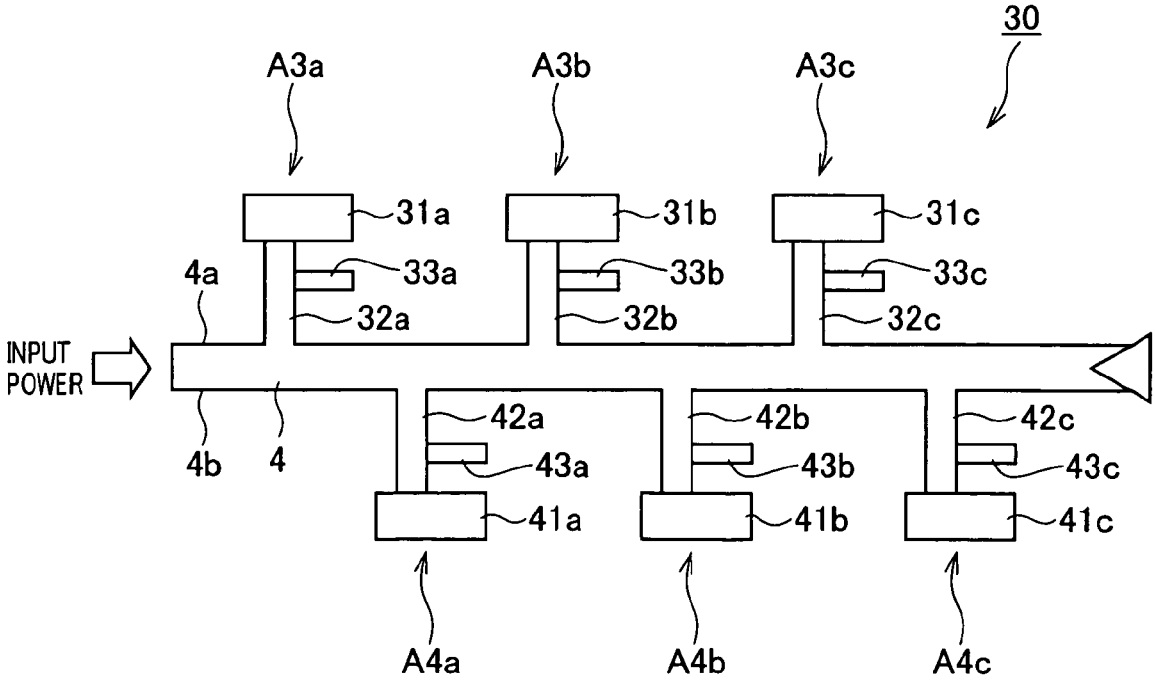
FIG. 11 is a plan view showing a structure of a microstrip array antenna according to a second embodiment of the invention.

Next, a microstrip array antenna 30 according to a second embodiment of the invention is described with respect to FIG. 11.

The microstrip array antenna 30 according to the second embodiment of the invention has a structure in which array elements A3*a*, A3*b*, A3*c*, A4*a*, A4*b* and A4*c* are connected to either side edge of the main feeding strip line 4. The number of the array elements connected to the main feeding strip line 4 and the connection interval are the same like the first embodiment.

The array element A3*a*, which is the closest of the array elements connected to the first side edge 4*a* of the main feeding strip line 4 to the input end, is constituted of a sub-feeding strip line 32*a* connected to the main feeding strip line 4, a rectangular radiating antenna element 31*a* connected to the terminal end of the sub-feeding strip line 32*a*, and a stub 33*a* connected to a predetermined middle portion of the sub-feeding strip line 32*a*.

Likewise, the array element A3*b*, which is the second closest of the array elements connected to the first side edge 4*a* of the main feeding strip line 4 to the input end, is constituted of a sub-feeding strip line 32*b*, a rectangular radiating antenna element 31*b* and a stub 33*b*. The array element A3*c*, which is the third closest of the array elements connected to the first side edge 4*a* of the main feeding strip line 4 to the input end, is constituted of a sub-feeding strip line 32*c*, a rectangular radiating antenna element 31*c* and a stub 33*c*. The array element A4*a*, which is the closest of the array elements connected to the second side edge 4*b* of the main feeding strip line 4 to the input end, is constituted of a sub-feeding strip line 42*a*, a rectangular radiating antenna element 41*a* and a stub 43*a*. The array element A4*b*, which is the second closest of the array elements connected to the second side edge 4*b* of the main feeding strip line 4 to the input end, is constituted of a sub-feeding strip line 42*b*, a rectangular radiating antenna element 41*b* and a stub 43*b*. The array element A4*c*, which is third closest of the array elements connected to the second side edge 4*b* of the main feeding strip line 4 to the input end, is constituted of a sub-feeding strip line 42*c*, a rectangular radiating antenna element 41*c* and a stub 43*c*.

Next, the structures of the array elements are explained. Since the array elements A3*a*, A3*b*, A3*c*, A4*a*, A4*b* and A4*c* have the same shape, only the array element A3*a* which is the closest of the array elements connected to the first side edge 4*a* of the main feeding strip line 4 is explained with reference to FIG. 12.

Figure 12:
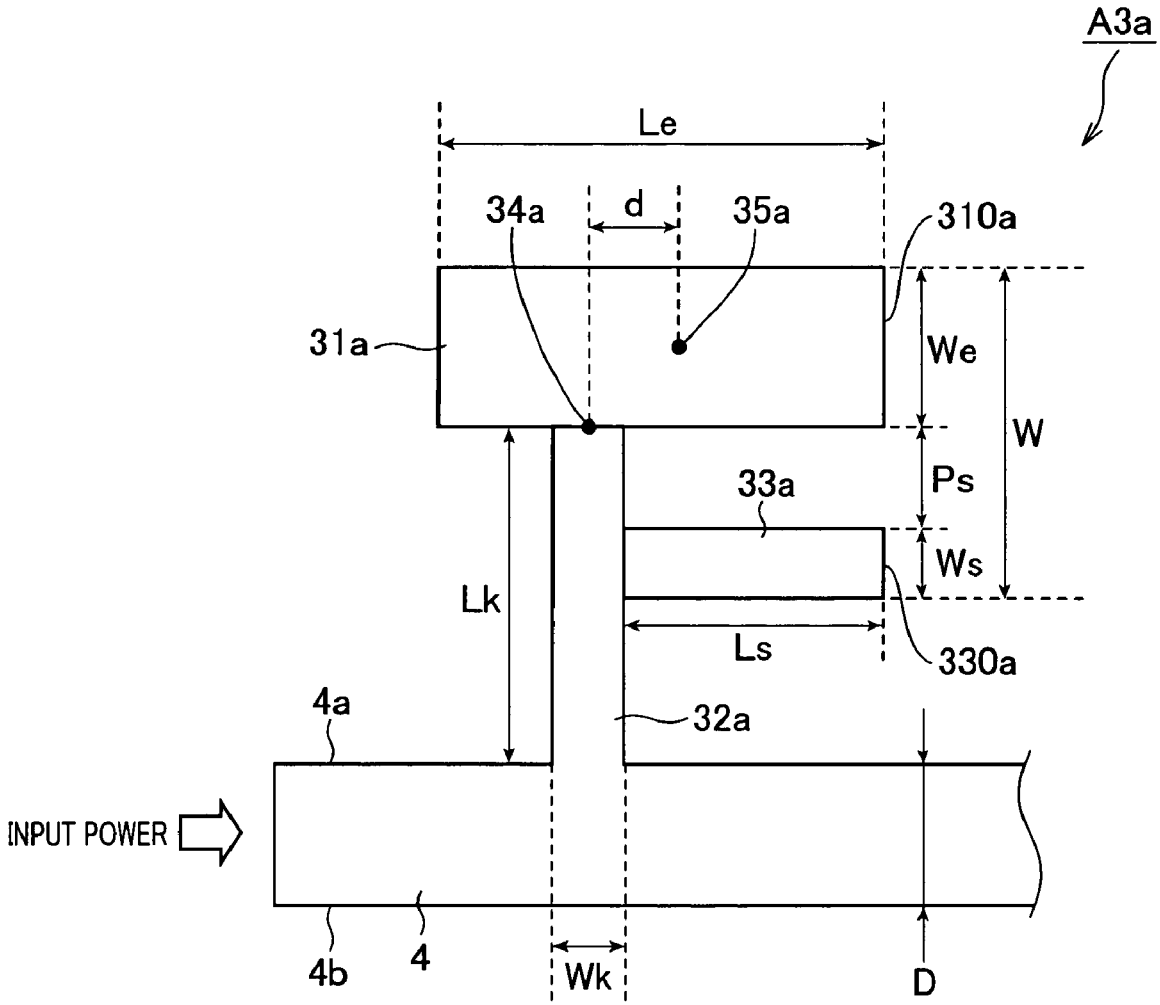
FIG. 12 is a plan view showing a detailed structure of one of array elements constituting the microstrip array antenna according to the second embodiment of the invention.

As shown in FIG. 12, the array element A3*a* is constituted of the straight sub-feeding strip line 32*a* extending from the main feeding strip line 4 with an angle of approximately 90 degrees with respect to the longitudinal direction of the main feeding line 4, the rectangular radiating antenna element 31*a* (having the element length Le equal to λg/2) connected to the terminal end of the sub-feeding strip line 32*a*, and the stub 33*a* extending from a predetermined position of the sub-feeding strip line 32*a* with an angle of an approximately 90 degrees to the longitudinal direction of the sub-feeding strip line 32*a* and in parallel to the longitudinal direction of the main feeding strip line 4.

The radiating antenna element 31*a* is formed in a rectangular shape so as to have the length Le smaller than its width We. The sub-feeding strip line 32*a* is connected to a feeding point 34*a* on a longer side of the radiating antenna element 31*a*. This feeding point 34*a* is set at a predetermined position between the center portion and one end portion of the longer side of the radiating antenna element 31*a*.

The radiating antenna element 31*a* is disposed such that its longitudinal direction is in parallel with the longitudinal direction of the stub 33*a*. That is, the longitudinal directions of both the radiating antenna element 11*a* and the stub 13*a* are parallel to the longitudinal direction of the main feeding strip line 4. Accordingly, the radiation from the stub 33*a* can be used as an effective radiation component as in the case of the first embodiment.

Also, like the first embodiment, the array element A3*a* is configured such that one of the contour edges of the radiating antenna element 31*a* as a field-emission edge line 310*a* and a field-emission edge line 330*a* of the stub 33*a* are on the same straight line.

Figure 13:
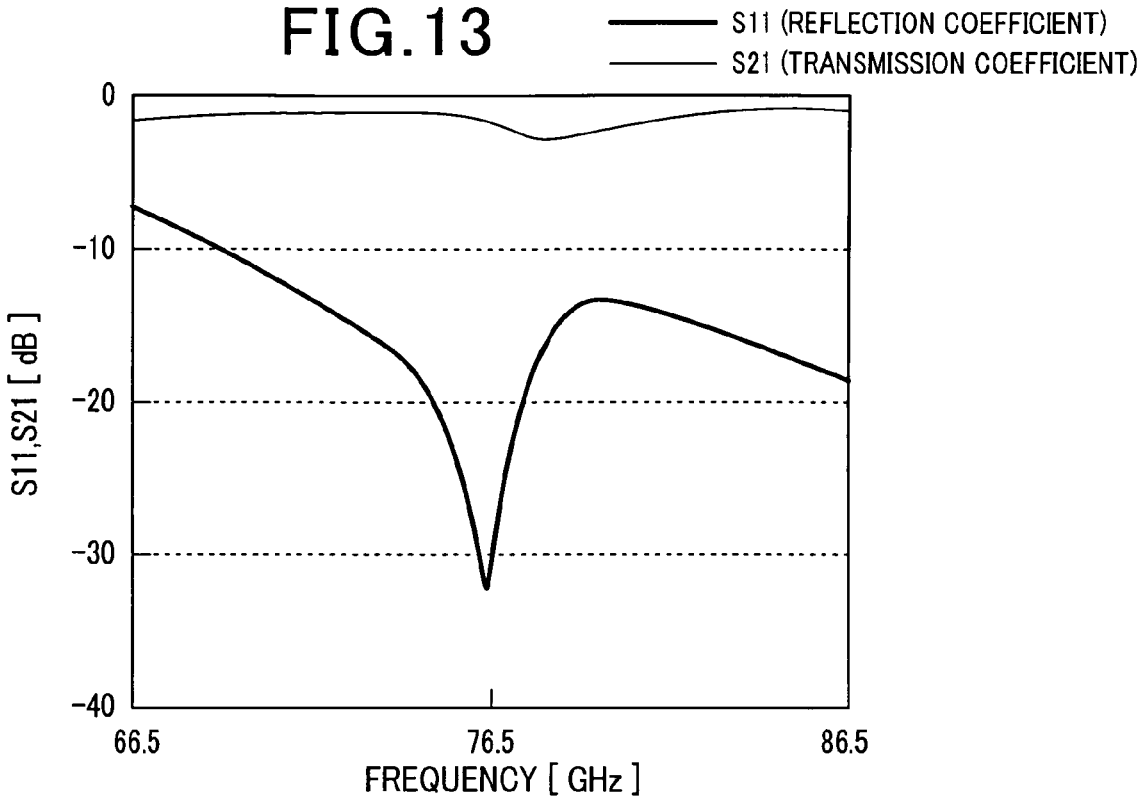
FIG. 13 is a graph showing the reflection characteristic and transmission characteristic of the array element of the microstrip array antenna of the second embodiment.

FIG. 13 is a graph showing the reflection characteristic S11 and the transmission characteristic S21 of the microstrip array antenna 30 of this embodiment, when the size parameters of the array element A3*a* are appropriately designed when the element width W is 1 mm, for example.

Compared with the characteristics of the array element of the first embodiment shown in FIG. 5, although the minimum value of the reflection coefficient S11 is −31.7 dB which is slightly lower than that in the first embodiment, it exhibits the excellent reflection characteristic compared to the conventional structure. As for the transmission characteristic, the second embodiment is equivalent to the first embodiment.

The other array elements A3*b* and A3*c* connected to the first side edge 4*a* of the main feeding strip line 4 and the array elements A4*a*, A4*b* and A4*c* connected to the second side edge 4*b* of the main feeding strip line 4 have the same structure as the array element A3*a* shown in FIG. 12.

That is, the array elements A3*a*, A3*b*, A3*c*, A4*a*, A4*b* and A4*c* constituting the microstrip array antenna 30 are so configured that the longitudinal directions of the radiating antenna elements 31*a*, 31*b*, 31*c*, 41*a*, 41*b* and 41*c*, and the stubs 33*a*, 33*b*, 33*c*, 43*a*, 43*b* and 43*c* are all parallel to one another.

Figure 14:
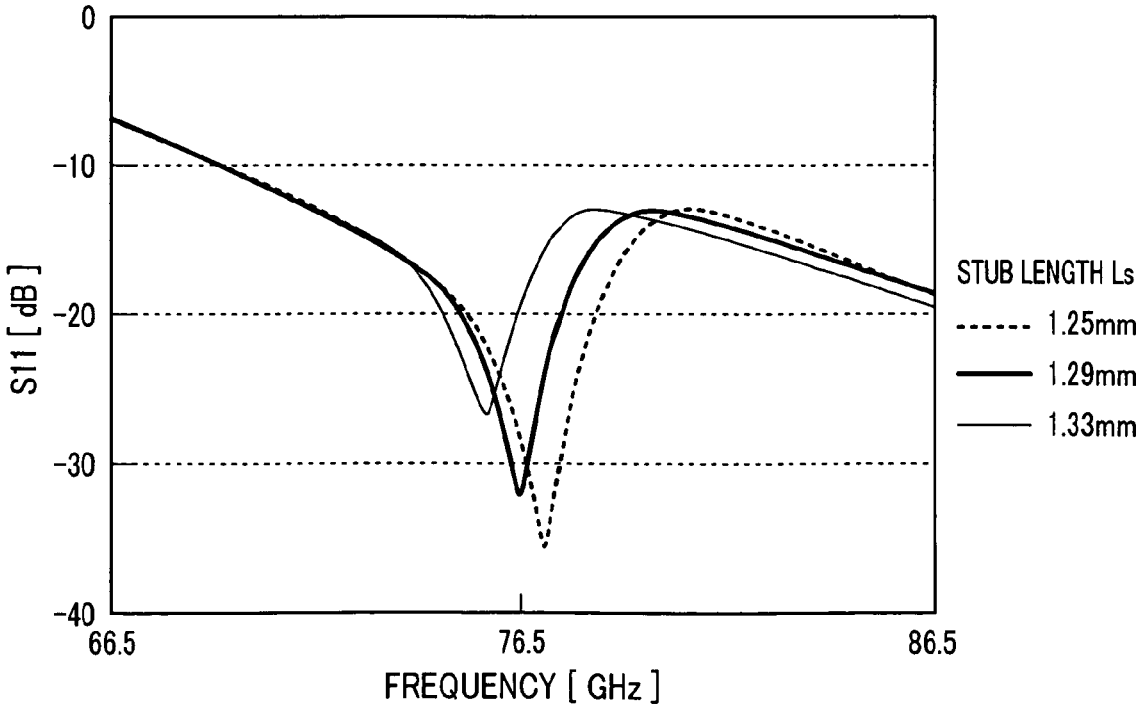
FIG. 14 is a graph showing variation of the reflection characteristic of the array element of the microstrip array antenna of the second embodiment when the length of the radiating antenna element is varied.
Figure 15:
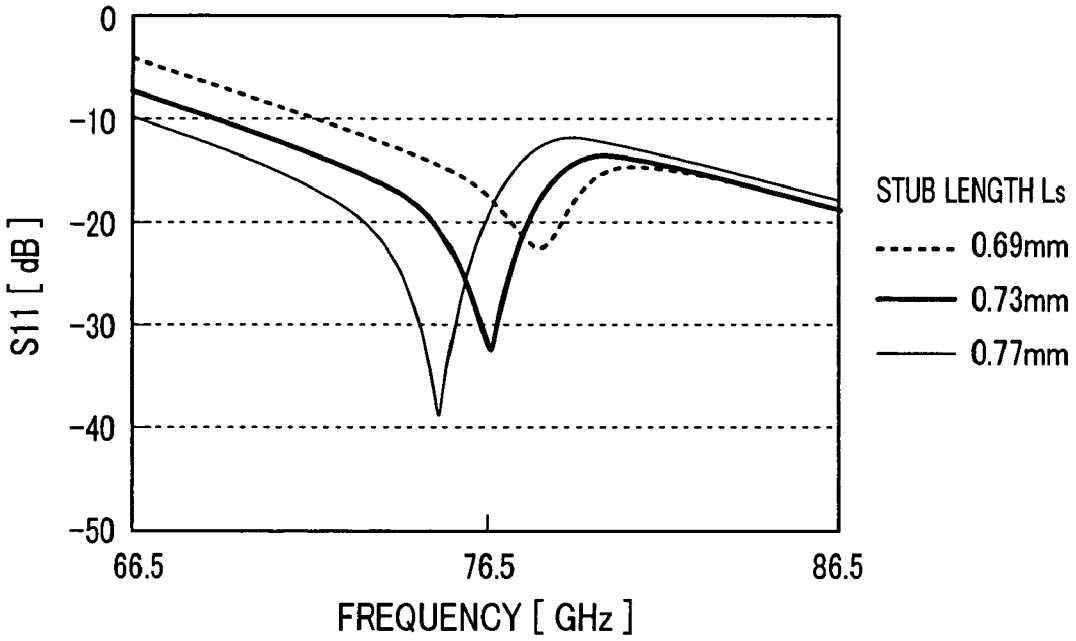
FIG. 15 is a graph showing variation of the reflection characteristic of the array element of the microstrip array antenna of the second embodiment when the length of its stub is varied.
Figure 16:
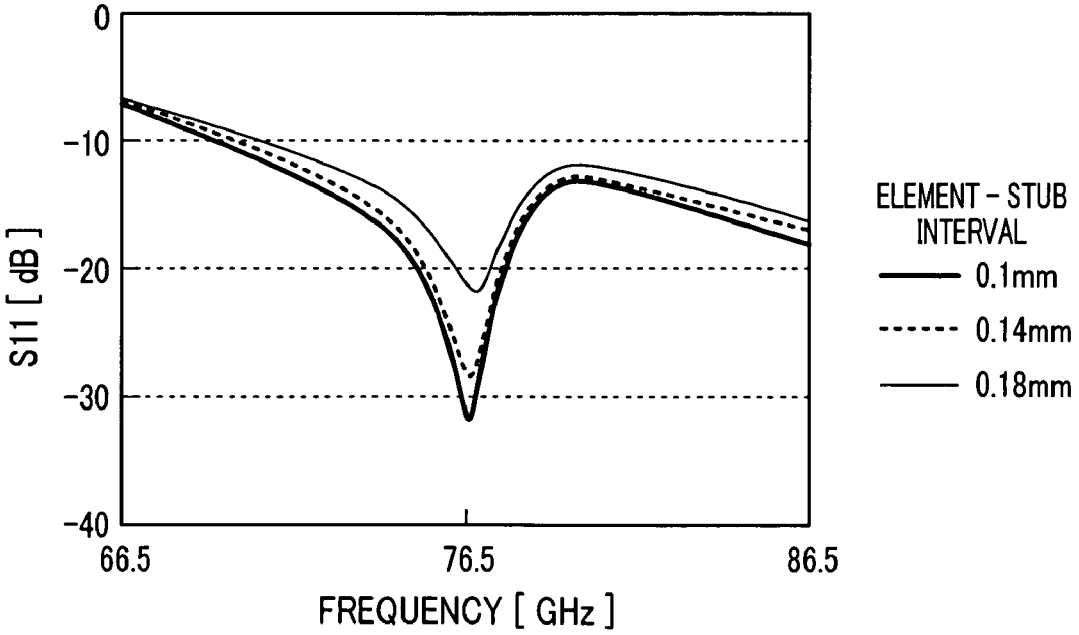
FIG. 16 is a graph showing variation of the reflection characteristic of the array element of the microstrip array antenna of the second embodiment when the interval between the radiating antenna element and the stub is varied.

Next, some relationships between the size parameters of the array elements A3*a*, A3*b*, A3*c*, A4*a*, A4*b* and A4*c* and the characteristics of the microstrip array antenna 30 are explained with reference to FIGS. 14 to 16. FIG. 14 is a graph showing variation of the reflection characteristic (reflection coefficient S11) when the element length Le of the radiating antenna element 31*a* shown in FIG. 12 is varied. FIG. 15 is a graph showing variation of the reflection characteristic (reflection coefficient S11) when the stub length Ls of the stub 33*a* is varied. FIG. 16 is a graph showing variation of the reflection characteristic (reflection coefficient S11) when the interval Pe between the radiating antenna element 31*a* and the stub 33*a* is varied.

As shown in FIG. 14, when the element length Le is varied, both the resonance frequency and the reflection coefficient S11 are varied. In this embodiment, since the operating frequency is 76.5 GHz, the optimum value of the element length Le is 1.29 mm. When the element length Le is reduced from this optimum value, the resonance frequency shifts to the lower side, and the reflection coefficient S11 at the resonance frequency increases. When the element length Le is increased from this optimum value, the reflection coefficient S11 at the resonance frequency decreases, however, the resonance frequency shifts to the higher side.

On the other hand, when the stub length Ls is varied, both the resonance frequency and the reflection coefficient S11 are varied as shown in FIG. 15. In this embodiment where the operating frequency is 76.5 GHz, the optimum value of the stub length Ls is 0.73 mm. When the stub length Ls is reduced from this optimum value, the resonance frequency shifts to the higher side, and the reflection coefficient S11 increases on the whole. When the stub length Ls is increased from this optimum value, the reflection coefficient S11 at the resonance frequency decreases, however, the resonance frequency shifts to the lower side.

As shown in FIG. 16, when the interval Pe between the radiating antenna element 31*a* and the stub 33*a* is varied, although the resonance frequency hardly varies, the minimum value of the reflection coefficient S11 varies. In this embodiment, as seen from FIG. 16, the optimum value of the interval Ps is 0.1 mm at which the reflection coefficient S11 becomes minimum.

The second embodiment described above provides the following advantages. The microstrip array antenna 30 has the structure in which each radiating antenna element is connected to the main feeding strip line 4 not directly but through the matching strip line. Accordingly, impedance matching can be achieved easily to reduce the reflection factor of each of the array elements A3*a*, A3*b*, A3*c*, A4*a*, A4*b* and A4*c*.

The provision of the matching strip line enables controlling the coupling factor of each of the array elements to some extent by adjusting the element lengths We and the size of the matching strip line (mainly, the stub length Ls). This enables each of the array elements to have a large coupling factor by appropriately designing the matching strip line without increasing the element widths We. This means that a desired coupling factor can be achieved, while suppressing the undesired cross-polarized components, and reducing the reflection from each of these array elements.

Also in this embodiment, each of the array elements A3*a*, A3*b*, A3*c*, A4*a*, A4*b* and 42*c* is formed such that the longitudinal direction of the radiating antenna element is parallel to the longitudinal direction of the stub so that the direction of the electric field radiated from the radiating antenna element coincides with the direction of the electric field radiated from the stub. Accordingly, also in this embodiment, since the radiation component from the stub, which is conventionally an undesired component, can be effectively used together with the main polarized component from the radiating antenna element, the radiation efficiency of the entire array element can be improved.

OTHER EMBODIMENTS

It is a matter of course that various modifications can be made to the above described embodiments as described below.

Although the present invention has been described by way of the first and second embodiments having the structures shown in FIG. 1 and FIG. 11, respectively, the microstrip array antenna of the present invention may have any structure if it includes the main feeding strip line 4 connected with array elements each including a sub-feeding strip line connected to the main feeding strip line 4, a rectangular radiating antenna element connected to the sub-feeding strip line, and a stub connected to the sub-feeding strip line.

Figure 17:
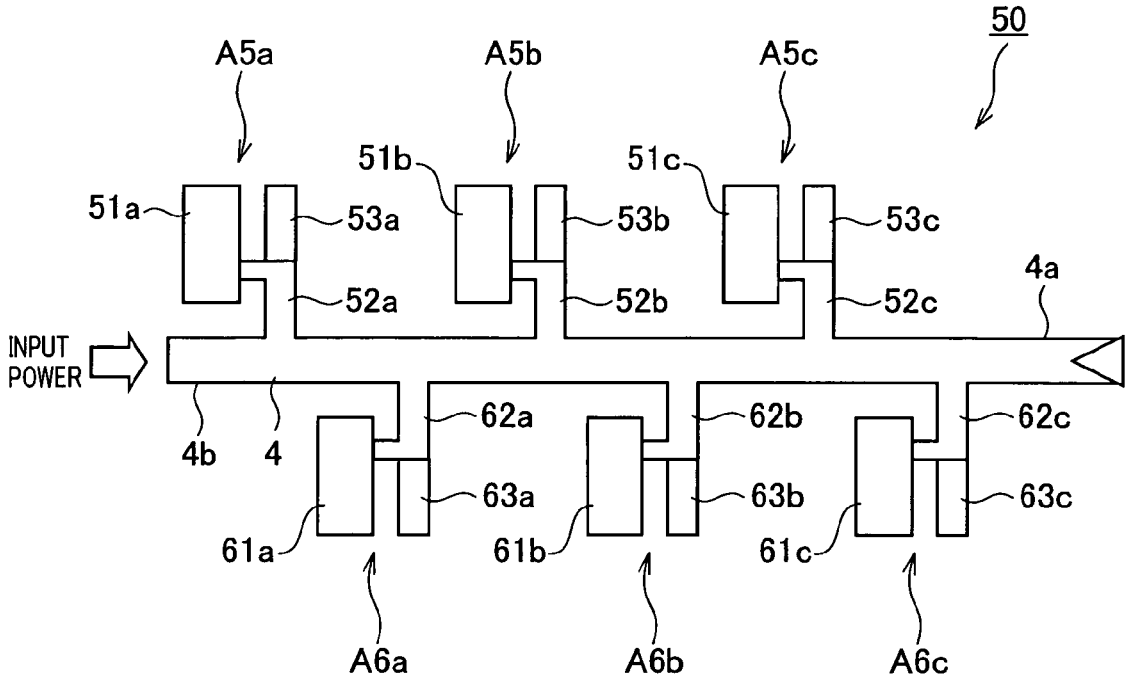
FIG. 17 is a plan view showing a structure of a microstrip array antenna of a modification of the embodiments of the invention.

For example, the present invention also provides a microstrip array antenna 50 shown in FIG. 17. As shown in this figure, the microstrip array antenna 50 has a structure in which the main feeding strip line 4 is connected with array elements A5*a*, A5*b*, A5*c*, A6*a*, A6*b* and A6*c* at either side edge thereof. The number of the array elements connected to the main feeding strip line 4 and the connecting intervals are the same as the first embodiment. Since the array elements A5*a*, A5*b*, A5*c*, A6*a*, A6*b* and A6*c* have basically the same shape, only the array element A5*a* which is the closest of the array elements connected to the first side edge 4*a* of the main feeding strip line 4 to the input end is explained here.

The array element A5*a* is constituted of an L-shaped sub-feeding strip line 52*a* extending from the main feeding strip line 4 with an angle of approximately 90 degrees with respect to the longitudinal direction of the main feeding line 4, a rectangular radiating antenna element 51*a* having the element length Ls equal to λg/2 and connected to the terminal end of the sub-feeding strip line 52*a*, and a stub 53*a* extending from a bent portion of the sub-feeding strip line 52*a* in the direction crossing the longitudinal direction of the main feeding strip line 4. The longitudinal directions of the radiating antenna element 51*a* and the stub 53*a* are parallel to each other.

The microstrip array antenna 50 having the structure shown in FIG. 17 is also capable of suppressing the undesired cross-polarized components, and reducing the reflection from each of these array elements like the first and second embodiments.

Figure 18A:
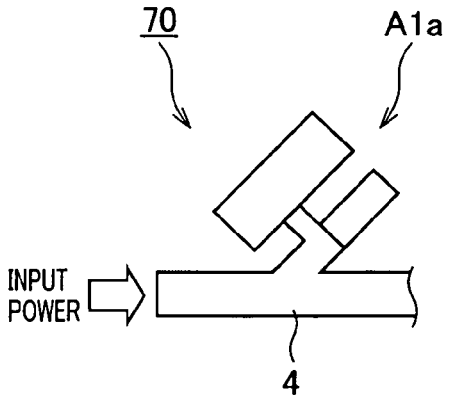
FIG. 18A is a plan view showing a structure of a microstrip array antenna in which only one array element is connected to one side edge of its main feeding strip line as a modification of the first and second embodiments.
Figure 18B:
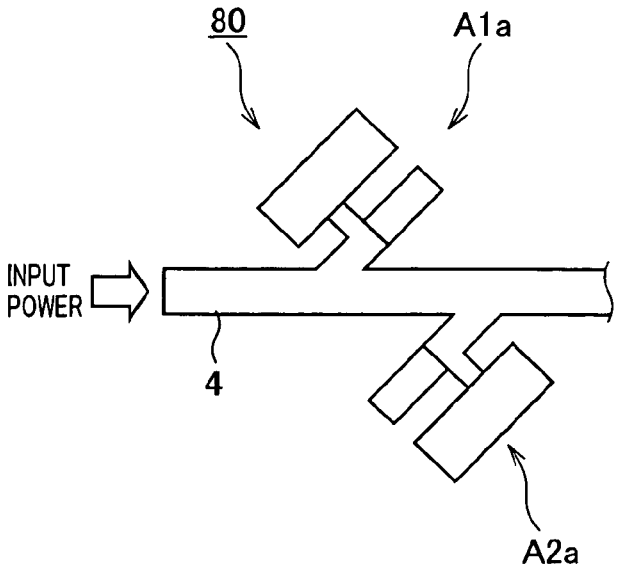
FIG. 18B is a plan view showing a structure of a microstrip array antenna in which one array element is connected to each side edge of its main feeding strip line as a modification of the first and second embodiments.

The microstrip array antennas of the above described embodiments have the structure in which the main feeding strip line 4 is connected with the array elements at both side edges thereof. However, the main feeding strip line 4 may be connected with the array elements at only one of the first side edge 4*a* and the second side edge 4*b* as shown in FIG. 18A Furthermore, the main feeding strip line 4 may be connected with only one array element at each side edge thereof as shown in FIG. 18B. When the main feeding strip line 4 is connected with array elements at both side edges thereof, the number of array elements connected to one side edge of the main feeding strip line 4 may be the same as or different from the number of array elements connected to other side edge of the main feeding strip line 4.

Then number of array elements to be connected to each side edge of the main feeding strip line 4 is determined depending on a required directivity etc. However, it should be noticed that to achieve a high directivity, it is preferable that the main feeding strip line 4 is connected with array elements at not only one side edge thereof but at both side edges thereof, as explained below with reference to FIGS. 18 and 19.

FIG. 18A shows a single-element antenna 70 having a structure in which the main feeding strip line 4 is connected with only one array element at one side edge thereof. FIG. 18B shows a two-element array antenna 80 having a structure in which the main feeding strip line 4 is connected with only one array element at each of two side edges thereof.

Figure 19:
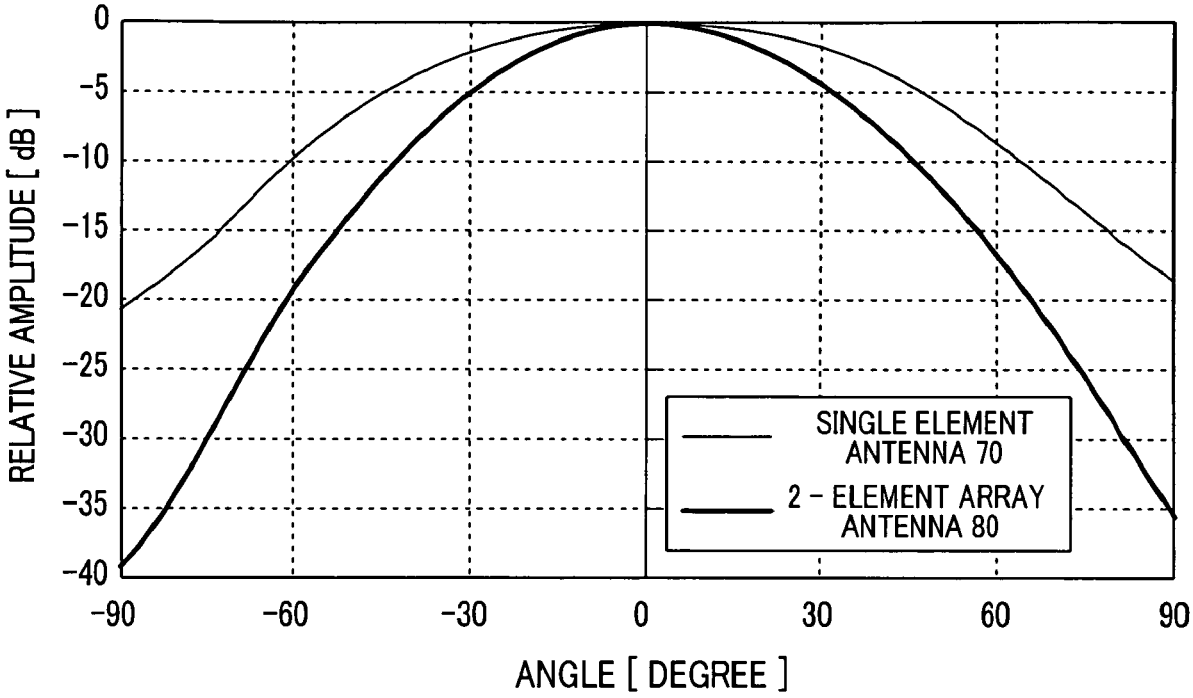
FIG. 19 is a graph showing horizontal directivities of the antennas showing in FIGS. 18A and 18B.

FIG. 19 is a graph showing horizontal directivities of the antennas 70 and 80. As shown in FIG. 19, although the antennas 70 and 80 are the same as for the relative amplitude in the main beam direction (amplitude at 0 degrees), the antenna 80 is superior to the antenna 70 as for the directivity. As exemplified above, to achieve a high directivity, it is preferable that the main feeding strip line 4 is connected with array elements at not only one side edge thereof but at both side edges thereof.

Since the lengths of the radiating antenna elements and the intervals at which the array elements are connected to the main feeding strip line should be determined depending on the characteristics required of the entire microstrip array antenna in relation to the waveguide wavelength λg, they may be n times (n being an integer larger than 1) those described in the embodiments. Also in this case, each radiating antenna element can radiate radia wave most efficiently.

The above explained preferred embodiments are exemplary of the invention of the present application which is described solely by the claims appended below. It should be understood that modifications of the preferred embodiments may be made as would occur to one of skill in the art.

What is claimed is:

1. A microstrip array antenna comprising:

a dielectric substrate formed with a conductive ground plate at a back surface thereof; and strip conductors formed on a front surface of said dielectric substrate;

said strip conductors including a linear main feeding strip line, and a plurality of array elements connected to said main feeding strip line, said array elements being disposed at least one of both sides of said main feeding strip line at a predetermined interval along a longitudinal direction of said main feeding strip line, each of said array elements including a sub-feeding strip line connected to said main feeding strip line, a rectangular radiating antenna element connected to a terminal end of said sub-feeding strip line, and a stub connected to said sub-feeding strip line, said stub being disposed between a connecting position between said main feeding strip line and said sub-feeding strip line and a connecting position between said sub-feeding strip line and said radiating antenna element;

wherein said array element is formed such that a direction of electrical field radiated from said stub and a direction of electrical field radiated from said radiating antenna element are the same with each other.

2. The microstrip array antenna according to claim 1, wherein said array elements are disposed at both sides of said main feeding strip line, each of said array elements being connected to one of both side edges of said main feeding strip line.

3. The microstrip array antenna according to claim 1, wherein said sub-feeding strip line is connected to a longer side edge of said radiating antenna element.

4. The microstrip array antenna according to claim 3, wherein said sub-feeding strip line is connected to a predetermined portion between a center and one end of said longer side edge of said radiating antenna element, excluding said center and said one end.

5. The microstrip array antenna according to claim 1 wherein said array element is formed such that a longitudinal direction of said radiating antenna element and a longitudinal direction of said stub are parallel to each other.

6. The microstrip array antenna according to claim 1 wherein said array element is formed such that a field-emission edge line of said radiating antenna element and a field-emission edge line of said stub are on the same straight line.

7. The microstrip array antenna according to claim 1, wherein a length of said radiating antenna element is equal to n/2 (n being a positive integer) times an effective wavelength of a radio wave at a predetermined operating frequency propagating through said main feeding strip line and entering said radiating antenna element.

8. The microstrip array antenna according to claim 1, wherein said array element is formed such that a field-emission edge line of said radiating antenna element is inclined by an angle larger than 0 degrees and smaller than 90 degrees with respect to said longitudinal direction of said main feeding strip line.

9. The microstrip array antenna according to claim 1, wherein said sub-feeding strip line is constituted of a first line section extending from one of both side edges of said main feeding strip line at one end thereof, a second line section extending from the other end of said first line section while being bent by a predetermined angle, and said stub extends straight from the other end of said first line section.

10. The microstrip array antenna according to claim 1, wherein each of said radiating antenna elements has a width depending on an excitation amplitude required thereof determined in order that said microstrip array antenna exhibits a desired directivity.

11. A microstrip array antenna comprising:

a dielectric substrate formed with a conductive ground plate at a back surface thereof; and strip conductors formed on a front surface of said dielectric substrate;

said strip conductors including a linear main feeding strip line, and at least one array element disposed at each of both sides of said main feeding strip line, said array element being connected to said main feeding strip line, said array element including a sub-feeding strip line connected to said main feeding strip line, a rectangular radiating antenna element connected to a terminal end of said sub-feeding strip line, and a stub connected to said sub-feeding strip line, said stub being disposed between a connecting position between said main feeding strip line and said sub-feeding strip line and a connecting position between said sub-feeding strip line and said radiating antenna element;

wherein said array element is formed such that a direction of electrical field radiated from said stub and a direction of electrical field radiated from said radiating antenna element are the same with each other.

12. The microstrip array antenna according to claim 11, wherein said sub-feeding strip line is connected to a longer side edge of said radiating antenna element.

13. The microstrip array antenna according to claim 12, wherein said sub-feeding strip line is connected to a predetermined portion between a center and one end of said longer side edge of said radiating antenna element, excluding said center and said one end.

14. The microstrip array antenna according to claim 11 wherein said array element is formed such that a longitudinal direction of said radiating antenna element and a longitudinal direction of said stub are parallel to each other.

15. The microstrip array antenna according to claim 11 wherein said array element is formed such that a field-emission edge line of said radiating antenna element and a field-emission edge line of said stub are on the same straight line.

16. The microstrip array antenna according to claim 11, wherein a length of said radiating antenna element is equal to n/2 (n being a positive integer) times an effective wavelength of a radio wave at a predetermined operating frequency propagating through said main feeding strip line and entering said radiating antenna element.

17. The microstrip array antenna according to claim 11, wherein said array element is formed such that a field-emission edge line of said radiating antenna element is inclined by an angle larger than 0 degrees and smaller than 90 degrees with respect to said longitudinal direction of said main feeding strip line.

18. The microstrip array antenna according to claim 11, wherein said sub-feeding strip line is constituted of a first line section extending from one of both side edges of said main feeding strip line at one end thereof, a second line section extending from the other end of said first line section while being bent by a predetermined angle, and said stub extends straight from the other end of said first line section.

19. The microstrip array antenna according to claim 11, wherein each of said radiating antenna elements has a width depending on an excitation amplitude required thereof determined in order that said microstrip array antenna exhibits a desired directivity.

* * * * *